US008133005B2

(12) United States Patent
Hsu et al.

(10) Patent No.: US 8,133,005 B2
(45) Date of Patent: Mar. 13, 2012

(54) BLOWER

(75) Inventors: Wei-Chun Hsu, Taoyuan Hsien (TW); Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 759 days.

(21) Appl. No.: 11/411,961

(22) Filed: Apr. 27, 2006

(65) Prior Publication Data

US 2007/0014661 A1 Jan. 18, 2007

(30) Foreign Application Priority Data

Jul. 15, 2005 (TW) ..... 94124126 A

(51) Int. Cl.
*F04D 25/16* (2006.01)

(52) U.S. Cl. ..... 415/60; 415/203; 416/120

(58) Field of Classification Search ..... 415/60, 415/62, 67, 66, 143, 183, 120, 124, 68, 203, 415/204; 361/694, 695
See application file for complete search history.

(56) References Cited

U.S. PATENT DOCUMENTS 519,650 A * 5/1894 Spang ..... 415/60
957,607 A * 5/1910 Higgins ..... 415/60
5,570,996 A * 11/1996 Smiley, III ..... 415/53.2
5,772,500 A * 6/1998 Harvey et al. ..... 454/184
6,108,203 A * 8/2000 Dittus et al. ..... 361/695

FOREIGN PATENT DOCUMENTS

JP 63080098 A * 4/1988

* cited by examiner

*Primary Examiner* — Edward Look
*Assistant Examiner* — Dwayne J White
(74) *Attorney, Agent, or Firm* — Birch, Stewart, Kolasch & Birch, LLP

(57) ABSTRACT

A blower includes a housing and a plurality of impellers. The impellers are disposed in the housing, and a mutual air-gathering passage is formed between the impellers and the housing. Compared to the prior art, the mutual air-gathering passage of the blower of the present invention can collect the airflow and stabilize the airflow. Thus, the air pressure at the air outlet is increased, and the overall airflow performance is improved.

20 Claims, 9 Drawing Sheets

BLOWER

This Non-Provisional application claims priority under U.S.C. §119(A) on Patent Application No(S). 0941124126, filed in Taiwan, Republic Of China on Jul. 15, 2005, the entire contents of which are hereby incorporated by reference.

BACKGROUND OF THE INVENTION

1. Field of Invention

The invention relates to a blower, and in particular to a blower having a plurality of impellers.

2. Related Art

Conventionally, blowers are classified into single side entry blowers and double side entry blowers. Referring to FIG. 1 and FIG. 2, FIG. 1 is a schematic illustration showing a conventional single side entry blower having a single impeller, and FIG. 2 is a cross-sectional view taken along the line A-A' in FIG. 1. In FIG. 1 and FIG. 2, a blower 1 includes a housing 11 and an impeller 12. The housing 11 has a top cover 111, a bottom cover 112 and an air outlet 113. The top cover 111 has an opening to serve as the air inlet 114 of the blower 1. When the impeller 12 rotates, the blades 121 of the impeller 12 forces the airflow by sucking air outside through the air inlet 114 and blowing out the air through the air outlet 113 of the housing 11.

In order to prevent the heat dissipation from stopping since the single blower breaks down, two blowers may be combined together. FIG. 3 is a schematic illustration showing a conventional combined blower having two blowers. FIG. 4 is a cross-sectional view taken along the line B-B' in FIG. 3. Referring to FIGS. 3 and 4, a combined blower 2 has a first blower 21 and a second blower 22. The first blower 21 and the second blower 22 respectively have air inlets 211 and 221 and air outlets 212 and 222. The air outlet 212 of the first blower 21 extends via a hollow housing 213 and is disposed with the air outlet 222 of the second blower 22 side by side, and the second blower 22 is stacked on the hollow housing 213.

The first blower 21 and the second blower 22 force the air to enter the first blower 21 and the second blower 22 through the air inlets 211 and 221, and then the airflows enter the respective air passage of first blower 21 and the second blower 22. Then, the airflows are blown out through the air outlets 212 and 222, respectively. That is the first blower 21 and the second blower 22 are two independent apparatuses. As the results, a larger space is needed to accommodate the two blowers. Also, an additional material, such as the hollow housing 213, is needed to assemble the two blowers. Therefore, the material cost is increased, but the airflow performance of the combined blower 2 is not enhanced comparing to two single blowers.

Thus, it is an important subject of the invention to provide a combined blower capable of integrating a plurality of blowers without wasting the material cost and enhancing airflow performance.

SUMMARY OF THE INVENTION

Embodiments of the invention provide a blower capable of integrating a plurality of blowers without wasting the material cost and enhancing airflow performance.

To achieve the above, the invention provides a blower including a housing and a plurality of impellers disposed in the housing. A mutual air-gathering passage is formed between the impellers and the housing.

Compared to the prior art, the mutual air-gathering passage of the blower of the present invention can collect the airflow and stabilize the airflow. Thus, the air pressure at the air outlet is increased, and the overall airflow performance is improved. In the preferred embodiment of the invention, the air inlet of the blower has a flange portion adjacent to the blades of the impeller so as to reduce reversed airflow and increase the air pressure of the blower.

In addition, the blower according to the preferred embodiment of the invention may further have a blocking member for preventing, the turbulent flow generated between the impellers. Furthermore, the blower according to the preferred embodiment of the invention may further have a movable member, which is moved to different positions according to the pressure difference so as to prevent the airflow from flowing back.

The above objectives and advantages of the present invention will become more readily apparent to those ordinarily skilled in the art after reviewing the following detailed description and accompanying drawings, in which:

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

First Embodiment

Figure 1:
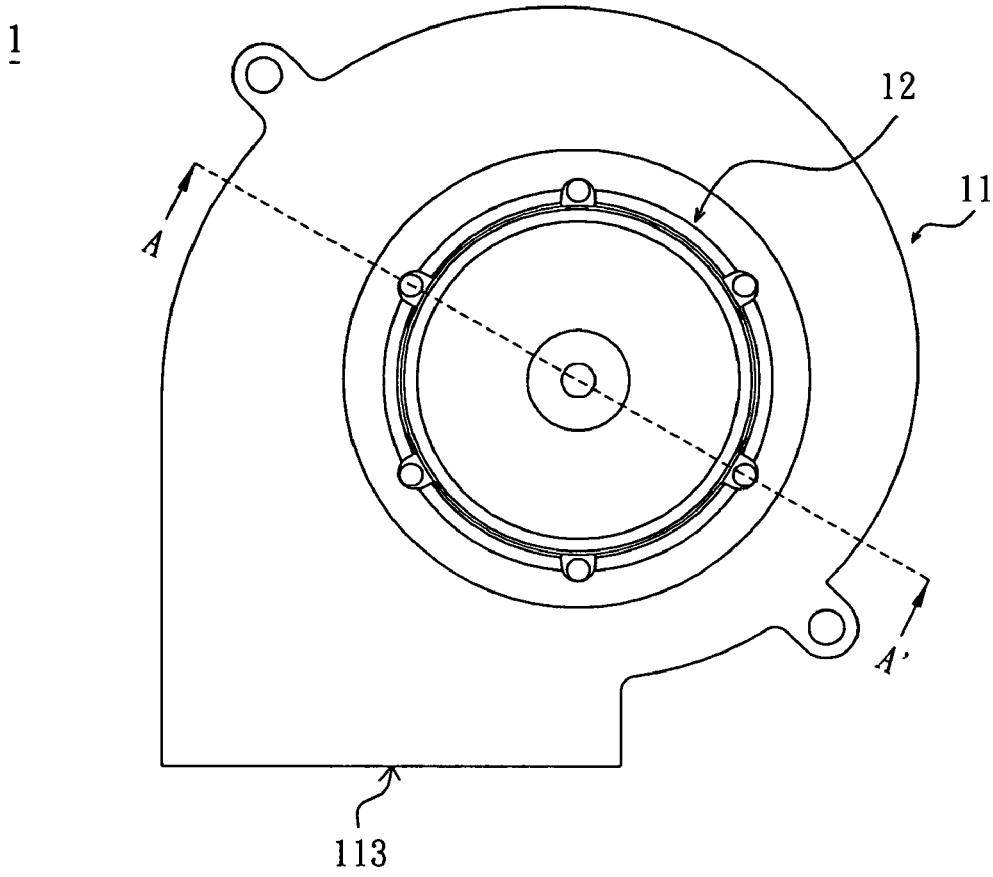
FIG. 1 (PRIOR ART)
FIG. 1 is a schematic illustration showing a conventional blower having a single impeller.
Figure 2:
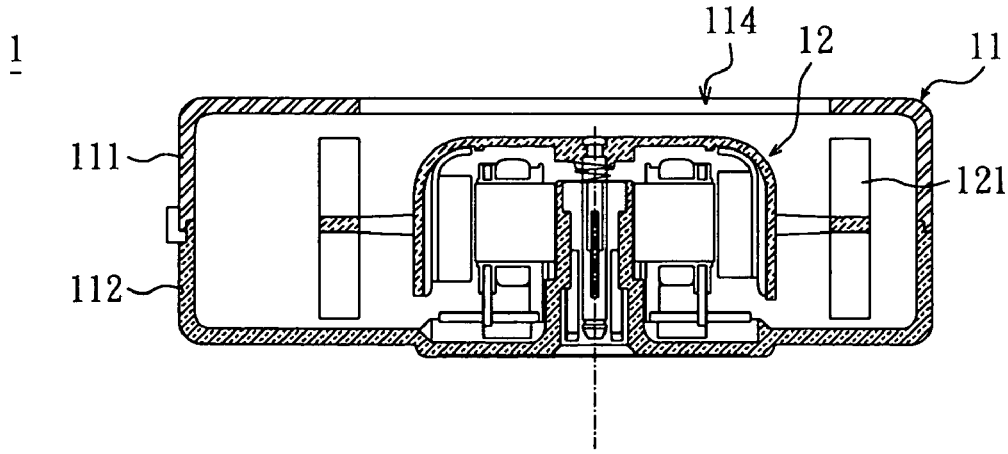
FIG. 2 (PRIOR ART)
FIG. 2 is a cross-sectional view taken along the line A-A' in FIG. 1.
Figure 3:
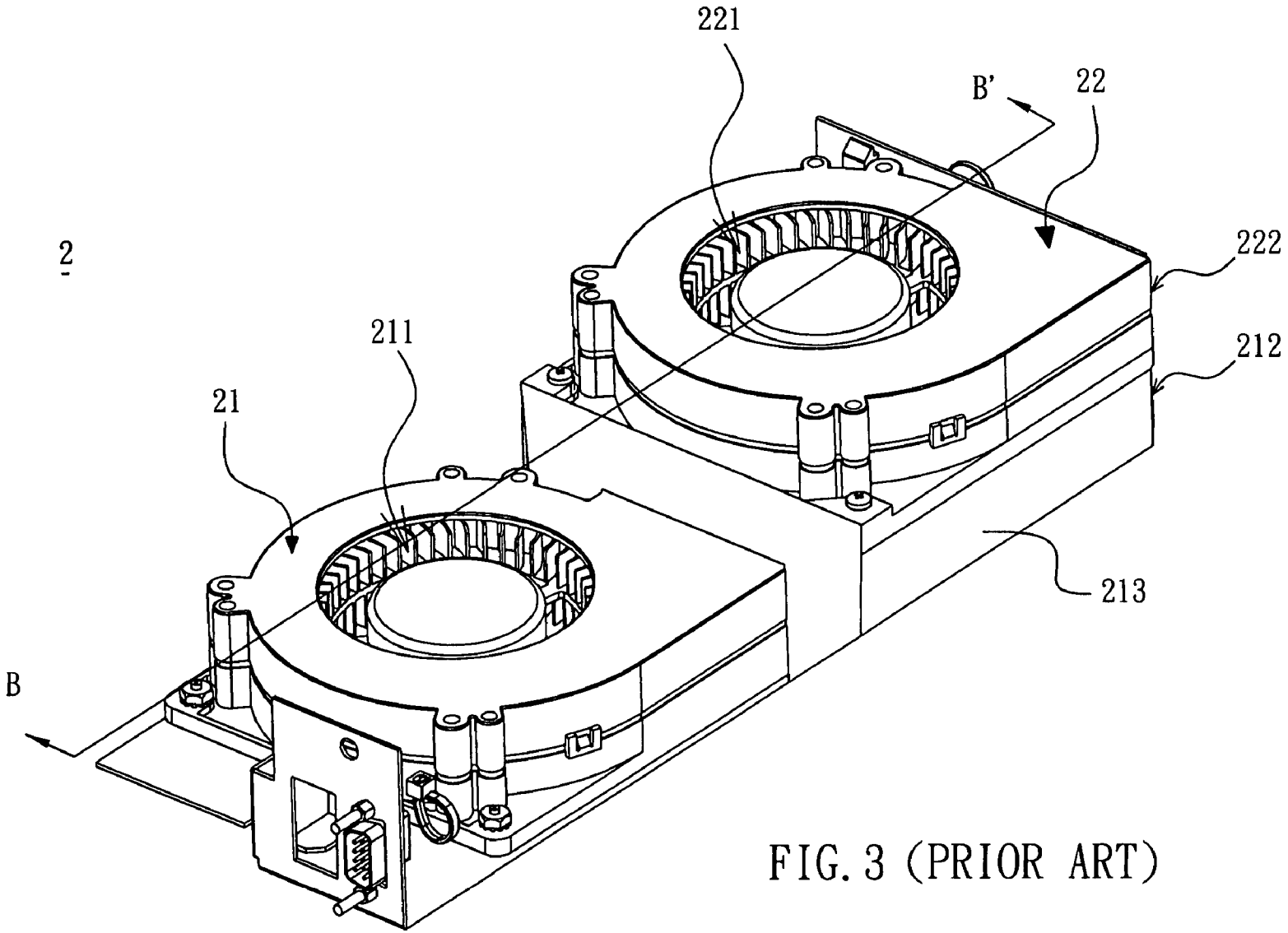
FIG. 3 (PRIOR ART)
FIG. 3 is a schematic illustration showing a conventional combined blower having two blowers.
Figure 4:
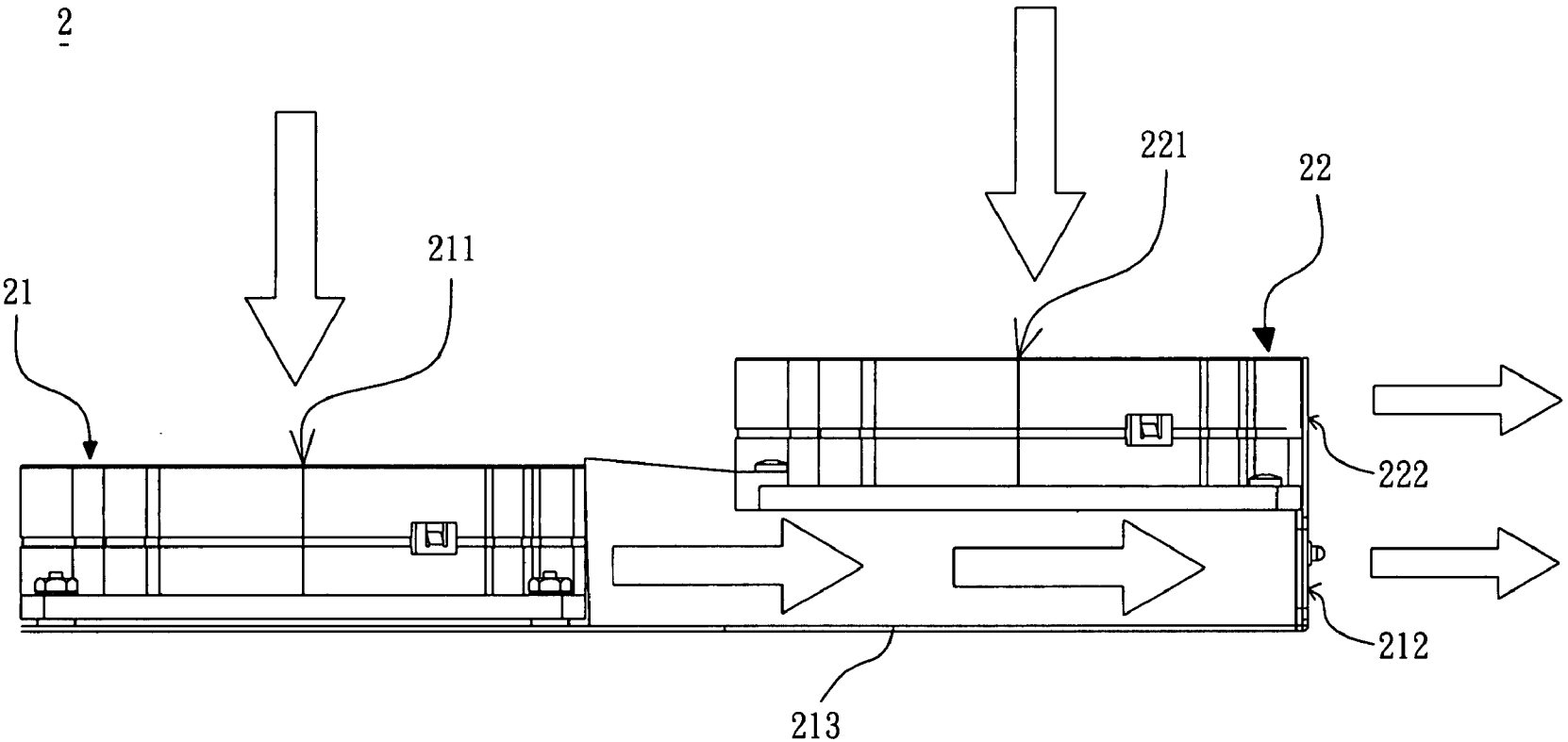
FIG. 4 (PRIOR ART)
FIG. 4 is a cross-sectional view taken along the line B-B' in FIG. 3.
Figure 5:
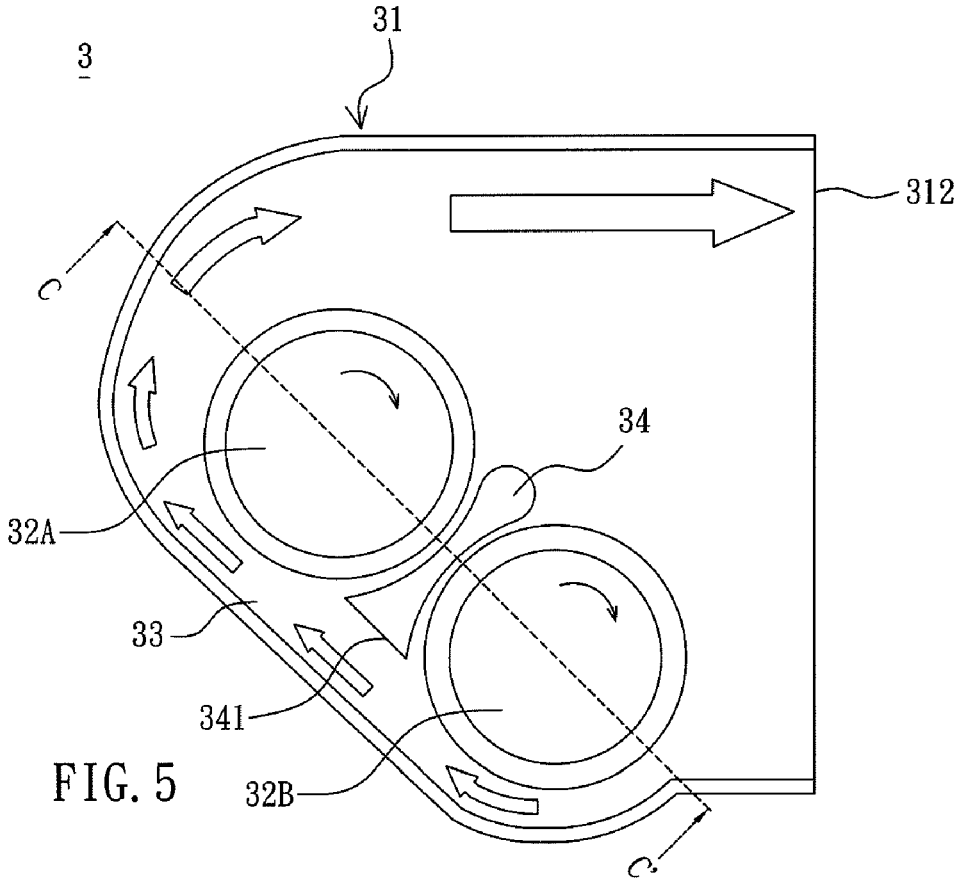
FIG. 5 is a top view showing a blower according to a first embodiment of the invention.

Referring to FIG. 5, a blower 3 includes a housing 31 and a plurality of impellers 32A and 32B.

Figure 6:
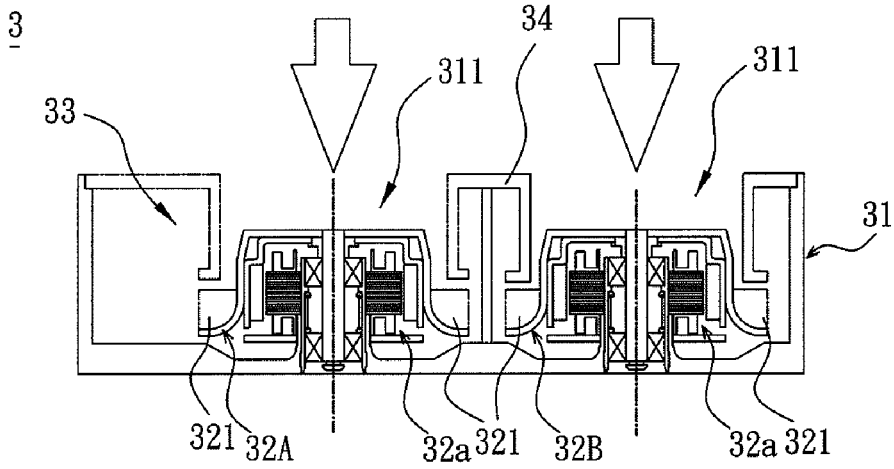
FIG. 6 is a cross-sectional view taken along the line C-C' of FIG. 5.

FIG. 6 is a cross-sectional view taken along the line C-C' of FIG. 5. Referring to FIG. 6, the blower 3 further includes a plurality of motors 32*a*. The housing 31 of this embodiment has two air inlets 311 respectively corresponding to the impellers 32. In addition, the housing 31 has an air outlet 312, such that the airflow outside enters the blower 3 through two air inlets 311 and then flows out through the single air outlet 312 when the impellers 32 rotate.

The impellers 32 are disposed in the housing 31, and a mutual air-gathering passage 33 is formed between the impellers 32 and the housing 31. Airflow outputs of the impellers 32 are interlinked in the mutual air-gathering passage 33. Each impeller 32 has a hub and a plurality of blades 321 outside on the bottom of the hub. The housing 31 has a plurality of flange portions 313 and each flange portion 313 is disposed at each air inlet 311. Each flange portion 313 extends to a location close to the top of the blade of each impeller 32 in the housing 31. End terminals of the flange portions 313 are above the blades 321. The top of the hub faces the corresponding air inlet 311, and the tops of the blades 321 are lower than the top of the hub. When the impellers 32 rotate, the blades are preferably rotated clockwise, for example. Parts of the airflow is collected between the impellers 32 and the housing 31 and flows along the mutual air-gathering passage 33 formed between the impellers 32 and the housing 31, as shown in the hollow arrows of FIG. 5. Then, the airflow is flowed out of the blower 3 through the single air outlet 312. When the airflow flows along the mutual air-gathering passage 33, the effect of stabilizing the airflow can be achieved, the air pressure at the air outlet 312 is increased, and the overall performance of the blower is improved.

In addition, the blower 3 of this embodiment may further include at least one blocking member 34, such as a baffle, disposed in the housing 31 and between the impellers 32 so that the turbulent flow between the adjacent impellers 32 is decreased, and the airflow performance of the blower 3 is enhanced. An end terminal 341 of the blocking member 34 is not connected to a side wall of the housing 31 so as to form a passage therebetween so that a part of the airflow from one of the impeller 32 flows toward the other one of the impellers 32. In addition, the shape of the blocking member 34 is not particularly limited, and the shape of the blocking member 34 can be changed according to the actual requirements.

Second Embodiment

Figure 7:
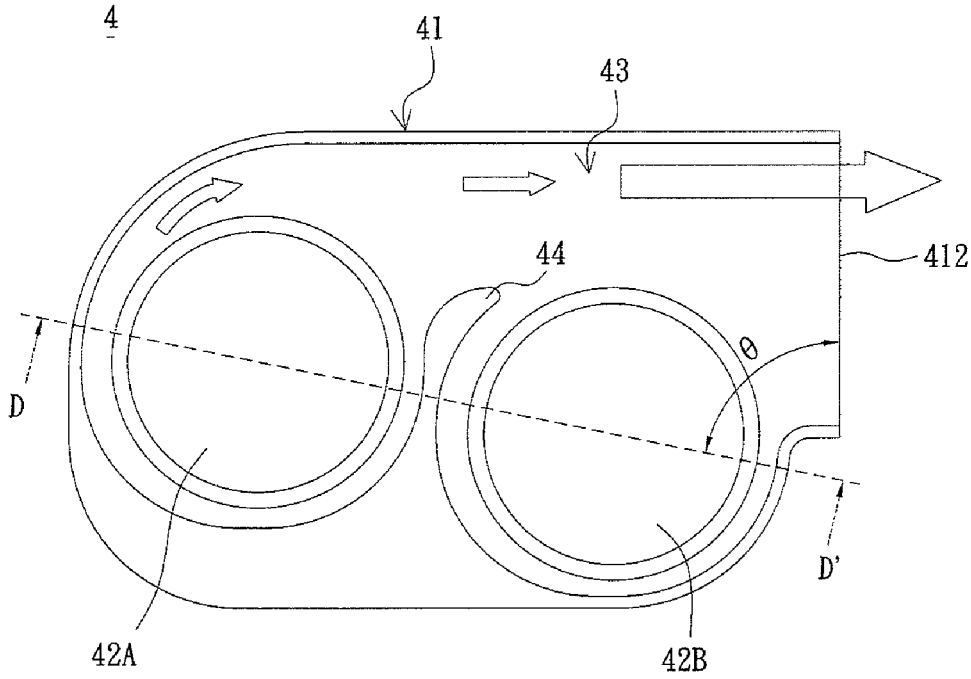
FIG. 7 is a top view showing a blower according to a second embodiment of the invention.

Referring to FIG. 7, a blower 4 includes a housing 41 and two impellers 42A and 42B disposed in the housing 41. A mutual air-gathering passage 43 is formed between the housing 41 and the impellers 42A and 42B.

As shown in FIG. 7, the housing 41 has an air outlet 412. Two impellers 42A and 42B are arranged in a straight line, and an angle Θ is formed between a cross section of the air outlet 412 and an imaginary line which connects the centers of the impellers 42A and 42B. The angle Θ is less than 90 degrees. That is, the impellers 42A and 42B are disposed unsymmetrically in the housing 41 so that the phenomenon of the interference between air streams driven by the impellers 42A and 42B may be reduced, which prevents the air quantity and the air pressure of the blower 4 from reducing.

Figure 8:
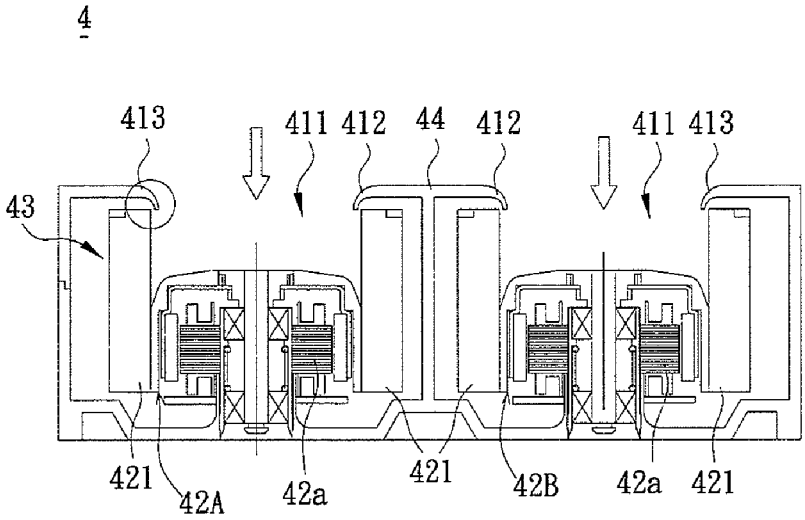
FIG. 8 is a cross-sectional view taken along the line D-D' in FIG. 7.

FIG. 8 is a cross-sectional view taken along the line D-D' in FIG. 7. Referring to FIGS. 7 and 8, the blower 4 further includes a plurality of motors 42*a*. The housing 41 has two air inlets 411 respectively corresponding to the impellers 42. The housing 41 has flange portions 413 at the air inlets 411, respectively, and each flange portion 413 has a curved shape.

Figure 9:
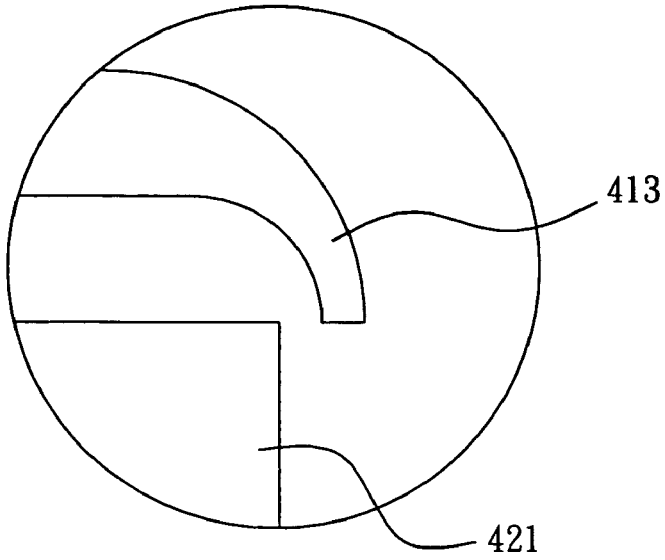
FIG. 9 and FIG. 10 are two enlarged views showing the flange portion of the blower according to the second embodiment of the invention.
Figure 10:
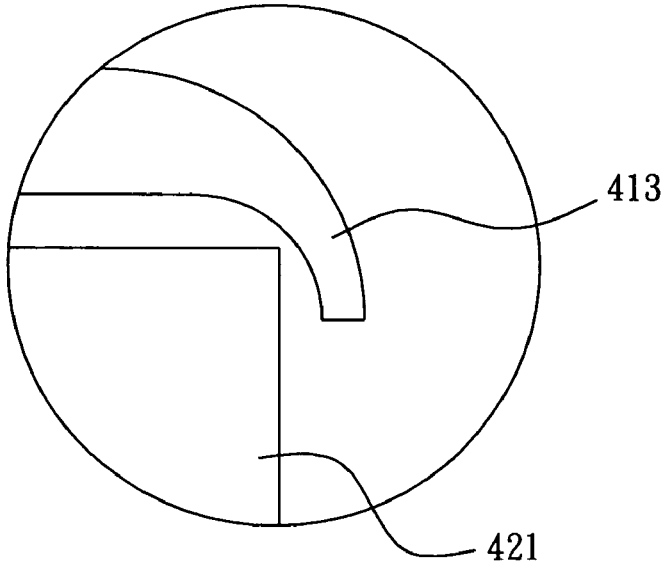

The impeller 42 has a plurality of blades 421, and the flange portions 413 are respectively adjacent to the blades 421. That is, ends of the flange portions 413 may be flush with the tops of the blades 421 at the same level, as shown in FIG. 9, which is an enlarged view showing the flange portion 413 of the blower 4 according to the second embodiment of the invention. Alternatively, the flange portions 413 may extend downward to cover a portion of the blades 421, as shown in FIG. 10.

Because the flange portions 413 of the air inlets 411 are disposed around the blades 421, the gaps between the blades 421 and the flange portions 413 are reduced so as to prevent reversed airflow. Also, the air pressure of the blower 4 is increased without increasing the air quantity driven by each impeller, and the blower 4 may have the characteristic of high back pressure.

In addition, the blower 4 of this embodiment may further include at least one blocking member 44 disposed in the housing 41 and between the impellers 42 so that the turbulent flow between the adjacent impellers 42 is decreased, and the airflow performance of the blower 4 is enhanced. In addition, the shape of the blocking member 44 is not particularly limited, and the shape of the blocking member 34 can be changed according to the actual requirements.

Third Embodiment

Figure 11:
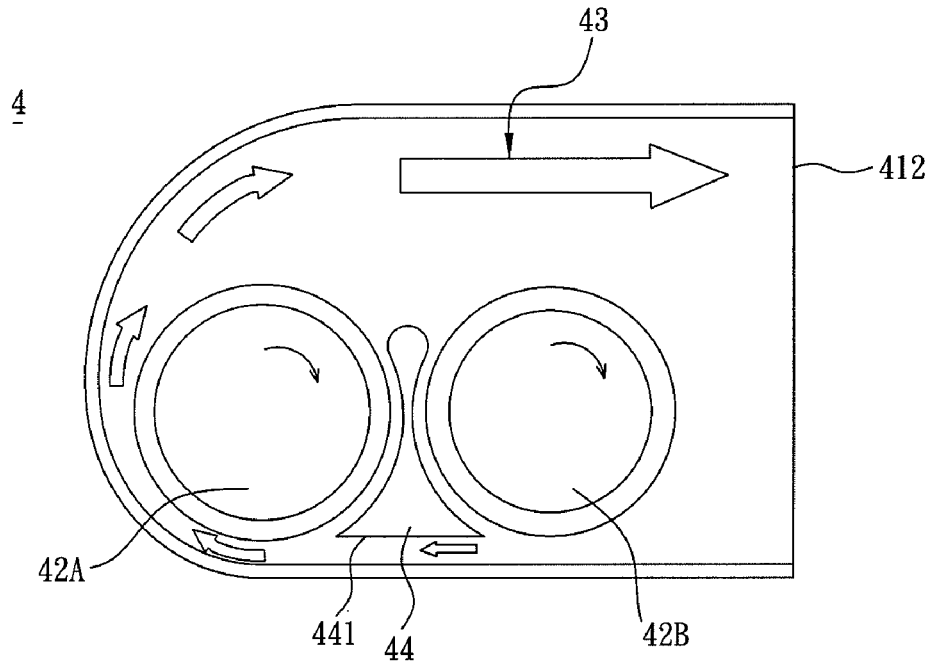
FIG. 11 is a top view showing a blower having two impellers according to a third embodiment of the invention, wherein the impellers are arranged along a straight line substantially perpendicular to an air outlet.

As shown in FIG. 11, two impellers 42 of the blower 4 are arranged in a straight line, and an angle θ is formed between a cross section of the air outlet 412 and an imaginary line which connects the centers of the impellers 42. The angle θ is substantially equal to 90 degrees. Airflow outputs of the impellers 42 are interlinked in a mutual air-gathering passage 43.

Figure 12:
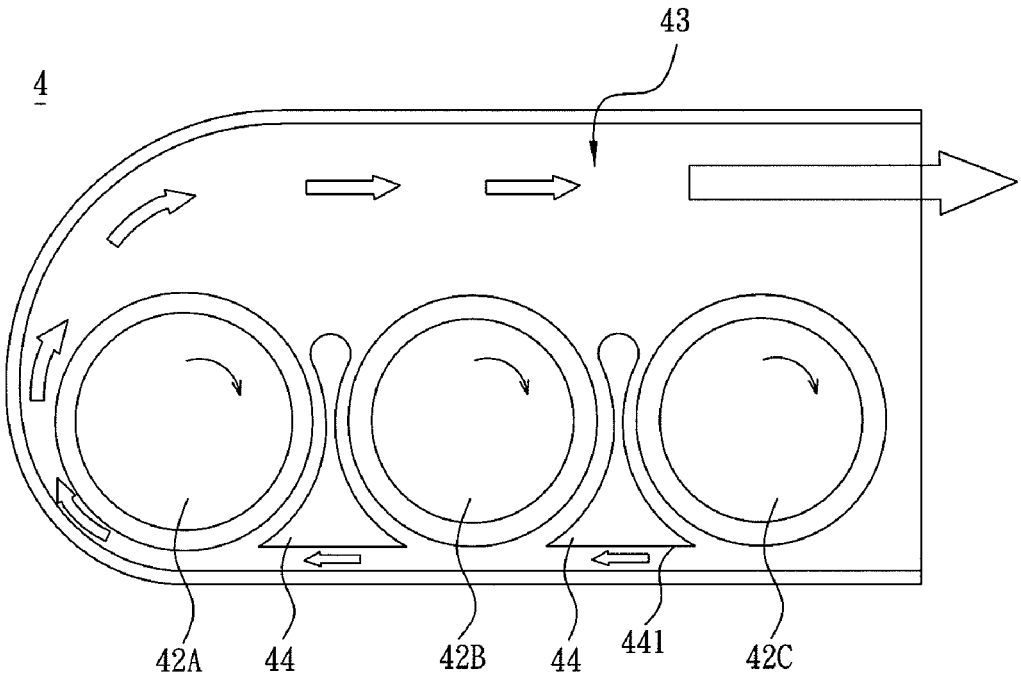
FIG. 12 is a top view showing another blower according to the third embodiment of the invention, wherein the blower has three impellers.

The blower 4 may also have more than two impellers 42, as shown in FIG. 12, which is a top view showing another blower according to the third embodiment of the invention. As shown in FIG. 12, the blower 4 may also have three impellers 42 and two blocking members 44. Each blocking member 44 is disposed between two adjacent impellers 42, and the mutual air-gathering passage 43 is formed between the housing 41 and the impellers 42. Because the blower 4 has a plurality of impellers 32 disposed in series, the overall performance of the blower 4 is enhanced.

In addition, the blower 4 may further include at least one blocking member 44, such as a baffle, disposed in the housing 41 and between the impellers 42A and 42B, as shown in FIG. 11 and (between the impellers 42A, 42B or 42B, 42C, as shown in FIG. 12), so that the turbulent flow between the adjacent impellers 42A and 42B (42A, 42B or 42B, 42C, as shown in FIG. 12) is decreased and the airflow performance of the blower 4 is enhanced. In addition, the shape of the blocking member 44 is not particularly limited, and the shape of the blocking member 34 can be changed according to the actual requirements. For example, the blocking member 44 is formed with an airflow-guiding portion 441, which is partially mounted around one of the impellers 42B, as shown in FIG. 13.

Figure 13:
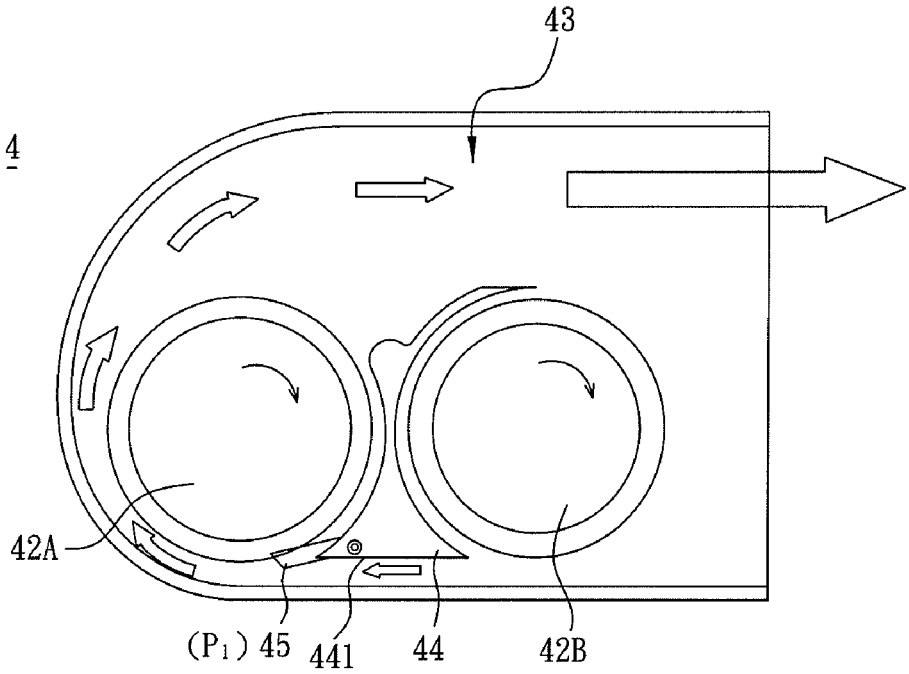
FIG. 13 is a top view showing still another blower according to the third embodiment of the invention, wherein the blower has a movable member in an open position.

In addition to the blocking member 44, the blower 4 may further include at least one movable member 45, which is disposed in the mutual air-gathering passage 43 represented by the hollow arrow symbols of FIG. 13. The movable member 45 is such as made of Mylar polyester films, acrylic resin, glass fiber, or any other filmy material.

Figure 14:
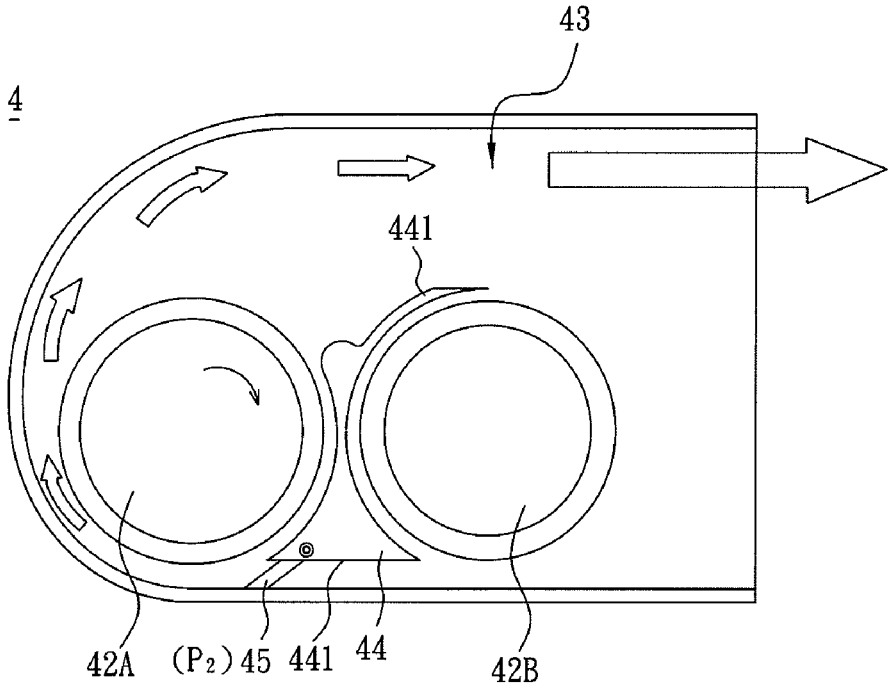
FIG. 14 is another top view showing the blower of FIG. 13, wherein the movable member of the blower is in a closed position.

As shown in FIG. 13 and FIG. 14, which are two top views showing another blower according to the third embodiment of the invention, the blower 4 has a movable member 45 which is either in an open position or in a closed position. The movable member 45 is disposed in the housing by axial disposal, coaxial disposal, modular disposal, engagement or other equivalent way, and the movable member 45 may also be directly connected to the blocking member 44 by axial disposal, coaxial disposal, modular disposal, engagement or other equivalent way. The movable member 45 is located at the open position P1 or the closed position P2 to control airflow flowing through the mutual air-gathering passage. The movable member 45 is moved to different positions due to the different pressure of the airflow. When the impellers 42A and 42B work normally, the airflow drives the movable member 45 to move to the open position P1, as shown in FIG. 13. When one of the impellers, such as the impeller 42B of FIG. 14, is out of work, the movable member 45 is moved to the closed position P2 due to the pressure difference, such that the airflow of the impeller 42A cannot flow back to the passage which is close to the impeller 42B and the airflow performance is enhanced.

Figure 15:
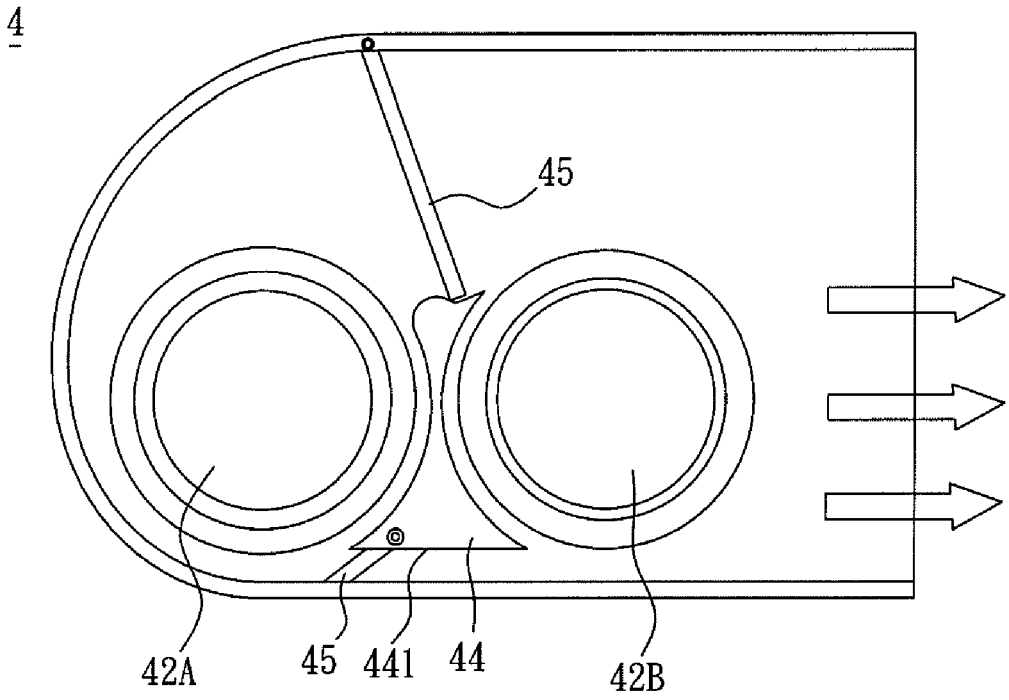
FIG. 15 is still another top view showing the blower of FIG. 13, wherein the blower has two movable members, both of which are in the close positions.

Of course, the movable member 45 may also be disposed on a top wall, a sidewall, or a bottom wall of the housing 41 of the blower 4 by axial disposal, coaxial disposal, modular disposal, engagement or other equivalent way. Referring to FIG. 15, which is still another top view showing the blower of FIG. 13, wherein the blower 4 has two movable members 45 and 46, both of which are in the closed positions. The blocking member 44 is directly connected to the movable member 45 by axial disposal, coaxial disposal, modular disposal, engagement or other equivalent way. The other movable member 46 is disposed on the sidewall of the housing 41 by axial disposal, coaxial disposal, modular disposal, engagement or other equivalent way. When the movable member 46 is in the closed position, the movable member 46 touches the blocking member 44 so as to block the airflow completely and thus prevent the airflow from flowing back to the inactive impeller.

Compared to the prior art, the mutual air-gathering passage of the blower of the present invention can collect the airflow and stabilize the airflow. Thus, the air pressure at the air outlet is increased, and the overall airflow performance is improved. In the preferred embodiment of the invention, the air inlet of the blower has a flange portion adjacent to the blades of the impeller so as to reduce reversed airflow and increase the air pressure of the blower.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A blower, comprising:

a single housing having a plurality of flange portions;

a first impeller and a second impeller disposed in the single housing, wherein a mutual air-gathering passage is formed between the first and second impellers and the single housing, wherein airflow outputs of the first and second impellers are interlinked in the mutual air-gathering passage, at least one of the first and second impellers has a plurality of blades, and end terminals of the flange portions are above the blades;

a plurality of motors, wherein each of the impellers is driven by a corresponding one of the motors, and the impellers are located on a same surface of the single housing; and a blocking member disposed in the housing and between the first and second impellers, wherein an end terminal of the blocking member is not connected to a side wall of the housing so as to form a passage therebetween so that a part of the airflow from first impeller flows toward the second impeller.

2. The blower according to claim 1, wherein the single housing has a plurality of air inlets corresponding to the first and second impellers, respectively.

3. The blower according to claim 2, wherein each of the first and second impellers has a plurality of blades, each flange portion is disposed at each air inlet and extended from the single housing to a location close to tops of the blades of each impeller in the single housing.

4. The blower according to claim 2, wherein the flange portions are extended from the single housing, and each flange portion is disposed at each air inlet and has a curved shape.

5. The blower according to claim 4, wherein each of the first and second impellers has a plurality of blades, and the flange portions are adjacent to the blades.

6. The blower according to claim 4, wherein ends of the flange portions extend to locations flush with tops of the blades at the same level.

7. The blower according to claim 4, wherein the flange portions extend downward to cover a portion of the blades.

8. The blower according to claim 2, wherein the single housing has an air outlet such that an airflow enters the single housing through the air inlets and then flows out through the air outlet.

9. The blower according to claim 1, wherein the first and second impellers are arranged in a straight line or in an unsymmetrical manner.

10. The blower according to claim 8, wherein an angle is formed between a cross section of the air outlet and an imaginary line which connects centers of the first and second impellers.

11. The blower according to claim 10, wherein the angle is equal to or less than 90 degrees.

12. The blower according to claim 1, wherein the blocking member is formed with an airflow-guiding portion, and the airflow-guiding portion is partially mounted around one of the first and second impellers.

13. The blower according to claim 1, further comprising at least one movable member disposed in the mutual air-gathering passage.

14. The blower according to claim 13, wherein the movable member is either in an open position or in a closed position to control airflow flowing through the mutual air-gathering passage.

15. The blower according to claim 13, wherein the movable member comprises Mylar polyester films, acrylic resin, glass fiber, or any other filmy material.

16. The blower according to claim 13, wherein the movable member is disposed on a top wall, a sidewall, or a bottom wall of the single housing.

17. The blower according to claim 13, wherein the movable member is disposed in the single housing by axial disposal, coaxial disposal, modular disposal, engagement or other equivalent way.

18. The blower according to claim 13, wherein the blocking member is directly connected to the movable member.

19. The blower according to claim 18, wherein the movable member is connected to the blocking member by axial disposal, coaxial disposal, modular disposal, engagement or other equivalent way.

20. A blower comprising:

a housing having a plurality of air inlets and a plurality of flange portions;

a plurality of impellers disposed in the housing and corresponding to the plurality of air inlets, respectively, wherein a mutual air-gathering passage is formed between the plurality of impellers and the housing, and airflow outputs of the impellers are interlinked in the mutual air-gathering passage;

a blocking member disposed in the housing and between the impellers, wherein an end terminal of the blocking member is not connected to a side wall of the housing so as to form a passage therebetween so that a part of the airflow from one of the impeller flows toward the other one of the impellers, wherein each of the impellers has a hub and a plurality of blades outside on the bottom of the hub, the top of the hub faces the corresponding air inlet, and the tops of the blades are lower than the top of the hub, and wherein each of the flange portions is disposed at each of the air inlets and has a curved shape, and extended toward an inner side of the single housing close to tops of the blades of each of the impellers, and end terminals of the flange portions are above the blades.

* * * * *